US006349557B1

(12) United States Patent
Gresham

(10) Patent No.: US 6,349,557 B1
(45) Date of Patent: Feb. 26, 2002

(54) ICE MACHINE SPRAY TUBE

(75) Inventor: Joseph A. Gresham, Clarksville, TN (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/745,433

(22) Filed: Dec. 26, 2000

(51) Int. Cl.[7] ..... F25C 1/12
(52) U.S. Cl. ..... 62/347; 239/193; 239/548
(58) Field of Search ..... 62/74, 347; 239/193, 239/548, 568

(56) References Cited

U.S. PATENT DOCUMENTS

| | | | | | |
|---|---|---|---|---|---|
| 3,580,008 | A | | 5/1971 | Barnard et al. | 62/347 |
| 4,267,978 | A | * | 5/1981 | Manteufel | 239/193 |
| 4,412,429 | A | | 11/1983 | Kohl | 62/347 |
| 4,526,014 | A | | 7/1985 | Suyama et al. | 62/347 |
| 4,580,410 | A | | 4/1986 | Toya | 62/347 |
| 4,601,178 | A | | 7/1986 | Suyama et al. | 62/347 |
| 4,669,276 | A | | 6/1987 | Sakai et al. | 62/347 |
| 4,715,194 | A | | 12/1987 | Kito | 62/347 |
| 4,791,792 | A | | 12/1988 | Naruse et al. | 62/135 |
| 4,862,706 | A | | 9/1989 | Yoshida et al. | 62/347 |
| 4,869,076 | A | | 9/1989 | Saka et al. | 62/347 |
| 5,129,237 | A | | 7/1992 | Day et al. | 62/73 |
| 5,237,837 | A | | 8/1993 | Naruse et al. | 62/434 |
| 5,493,872 | A | | 2/1996 | Hibino et al. | 62/347 |
| 5,520,011 | A | | 5/1996 | Hibino | 62/347 |
| 5,738,280 | A | * | 4/1998 | Ruthenberg | 239/193 |

* cited by examiner

*Primary Examiner*—William E. Tapolcai
(74) *Attorney, Agent, or Firm*—Arent Fox Kintner Plotkin & Kahn, PLLC

(57) ABSTRACT

A water sprinkling apparatus for an ice making machine. The sprinkling apparatus includes a spray tube formed by two snap fit parts from which water flows over onto vertical evaporator plates in the ice making machine. The open top channel body permits the water to flow easily as well as having the apparatus cleaned in a simpler and more efficient manner. Furthermore, particle buildup as well as clogging of apertures is eliminated, thereby maintaining continuity of flow and simplifying maintenance.

18 Claims, 6 Drawing Sheets

ICE MACHINE SPRAY TUBE

BACKGROUND OF THE INVENTION

1. Field of the invention

This invention relates to a water sprinkling apparatus for commercial ice manufacturing machines having a flow-down evaporator that continuously supplies water throughout the ice making process.

2. Description of Related Art

Typically, in a water flow-down type ice making machine, a pair of ice making plates are vertically disposed in a back-to-back relation to each other with a refrigerating pipe positioned between the pair of ice making plates. The refrigerating pipe essentially comprises the evaporator in which a coolant is evaporated and the pipe is placed in intimate contact with the ice making plates to cool icing water that is scattered from a water sprinkling apparatus positioned above the ice making plates. The scattered water flows downward along the exposed surfaces of the ice making plates during the ice making operation.

After the ice making operation is performed, a high-temperature gas that is not condensed is forced through the refrigerating pipe to heat the ice making plates in order to melt the ice formed and adhering to the surfaces of the ice making plates. Thus, the formed ice is separated from the ice making, plates and is discharged from the ice making machine. The ice water sprinkling apparatus supplies a predetermined level of water flow to facilitate discharge of the ice from the ice making plates.

Referring to FIG. 1, an ice water sprinkler 11 feature of a known water sprinkling apparatus 10 is illustrated. The ice water sprinkler 11 includes a pair of elongated water scattering cylinders 12, each having a substantially rectangular cross section with a broad width. The water scattering cylinders 12 are joined together by a coupling portion 14. A water supply joint 15 projects from the coupling portion 14. Also, stoppers 13 are integrally formed with the icing water scattering cylinders 12 at respective outer shoulder portions thereof.

Turning to FIG. 2, a bottom view of the ice water sprinkler 11 is illustrated. A plurality of water scattering holes 16 are formed in a bottom wall of each of the ice water scattering cylinders 12 and are in communication with an ice water passage (not shown) defined within the scattering cylinders 12. A longitudinal recess 17 is integrally formed within the bottom surface of each of the ice water scattering cylinders 12. Each recess 17 is designed to snugly fit or receive a protrusion 18*a* of a deicing water sprinkler 18 that is used in conjunction with the ice water sprinkler 11 in a well-known manner.

FIG. 3 illustrates a portion of the ice making machine in which the water sprinkling apparatus 10 is assembled to include the ice water sprinkler 11 and the deicing water sprinkler 18. A pair of ice making plates 21 and 22 are positioned in a back-to-back opposite relation with an evaporator or refrigeration pipe 23 through which a coolant flows is disposed between the ice making plates 21 and 22. A lower half of the deicing water sprinkler 18 extends between the ice making plates 21 and 22.

A pair of water guide plates 19 and 20 are mounted at upper portions of the ice making plates 21 and 22, respectively, substantially in a V-like design to deflect the water scattered from the water scattering holes 16 of the ice water sprinkler 11 toward the surfaces of the ice making plates 21 and 22 so that the ice making process can be carried out.

This known water sprinkling apparatus can be assembled from a plurality of individual parts, thereby requiring a substantial amount of time for machining or molded from a die. Unfortunately, the assembly of parts requires a test for leakage. As such, most conventional water sprinkling apparatuses are both time consuming to manufacture, as well as difficult to clean. Furthermore, the water scattering holes 16 within the ice water sprinkler 11 may clog over time, thereby rendering the ice making machine inefficient.

SUMMARY OF THE INVENTION

It is the object of this invention to overcome the above-described drawbacks of the conventional ice water sprinkler.

Another object of this invention is to provide an ice water sprinkler wherein water flows through the center portion of a channel after the water level reaches a point of overflowing through an opening in a top surface of the channel body, the water flows over the side of the channel body onto the water guide plates below.

The ice water sprinkler of this invention comprises two distinct interfitting pieces that are easy to form, clean and maintain. As the channel body contains no apertures to be clogged, there is very little likelihood for down time due to a clogged water supply pipe. Furthermore, the amount of time necessary to manufacture the ice water sprinklers is decreased as verification of holes being formed in the channel body are not necessary due to the structure of this invention.

BRIEF DESCRIPTION OF THE DRAWINGS

These and other objects and advantages of this invention will become more fully apparent from the following detailed description when read in conjunction with the accompanying drawings with like reference numerals indicating corresponding parts throughout, wherein.

DETAILED DESCRIPTION OF THE PREFERRED EMBODIMENT

Figure 1:
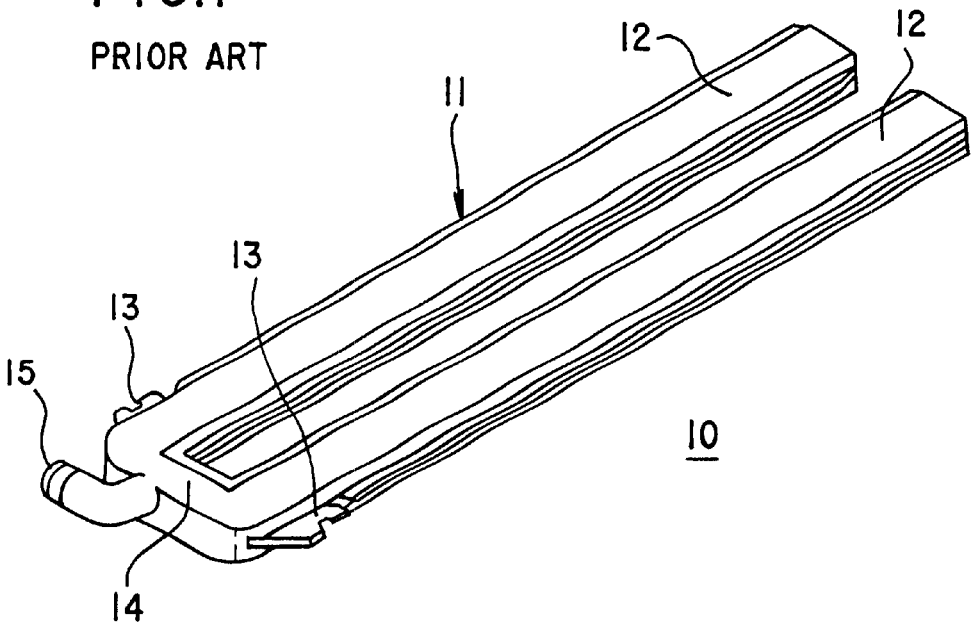
FIG.1 PRIOR ART
FIG. 1 is a perspective view illustrating the ice water sprinkler feature of a conventional ice water sprinkling apparatus.
Figure 2:
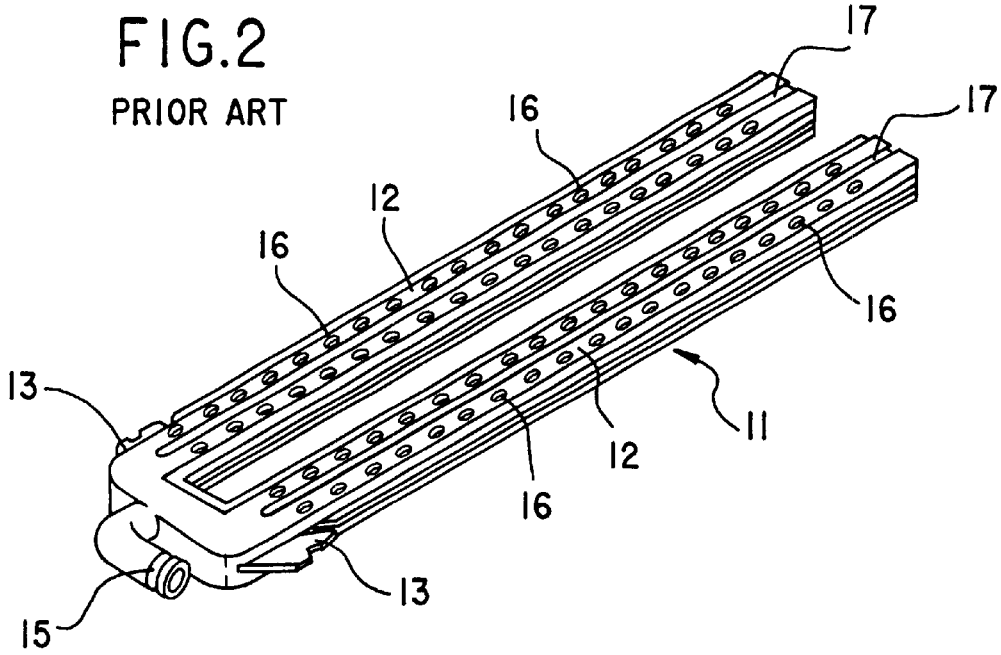
FIG.2 PRIOR ART
FIG. 2 is a bottom view of the icing water sprinkler of FIG. 1.
Figure 3:
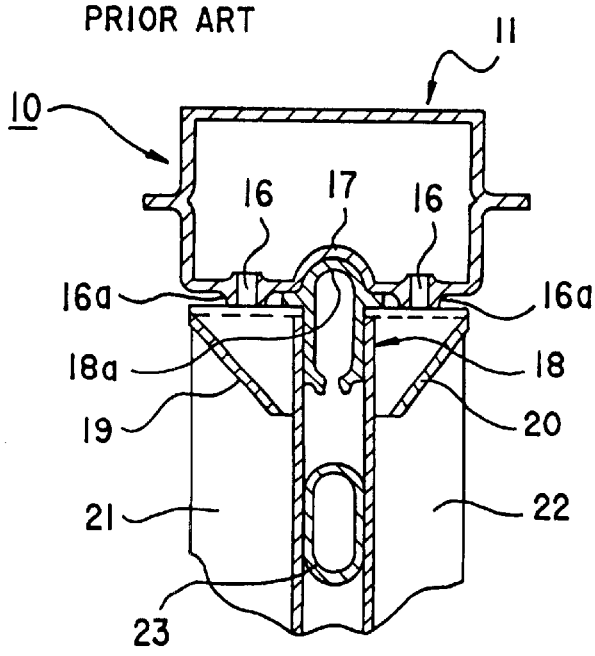
FIG.3 PRIOR ART
FIG. 3 is a perspective view illustrating operation of the conventional water sprinkling apparatus illustrated in FIG. 1.
Figure 4:
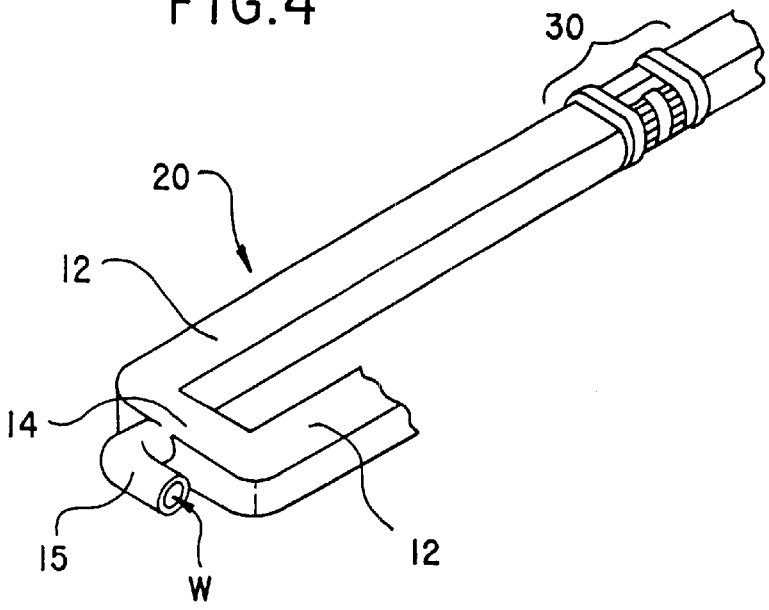
FIG. 4 is a perspective view of the ice water sprinkler according to this invention.

FIG. 4 illustrates a perspective view of the ice water sprinkler 20 of this invention. As in the conventional ice water sprinkler 11 described above in FIGS. 1–3, the ice water sprinkler 20 of this invention includes at least two water scattering cylinders or spray tubes 30 connected by a coupling portion 14 with a water supply joint 15 extending therefrom. Furthermore, it should be noted that the components discussed below and herein are manufactured from any suitable material, such as, for example only, Acrylonitrile Butadiene Styrene (ABS) or other National Sanitation Foundation (NSF) approved plastic that can withstand an injection molding process.

Figure 5:
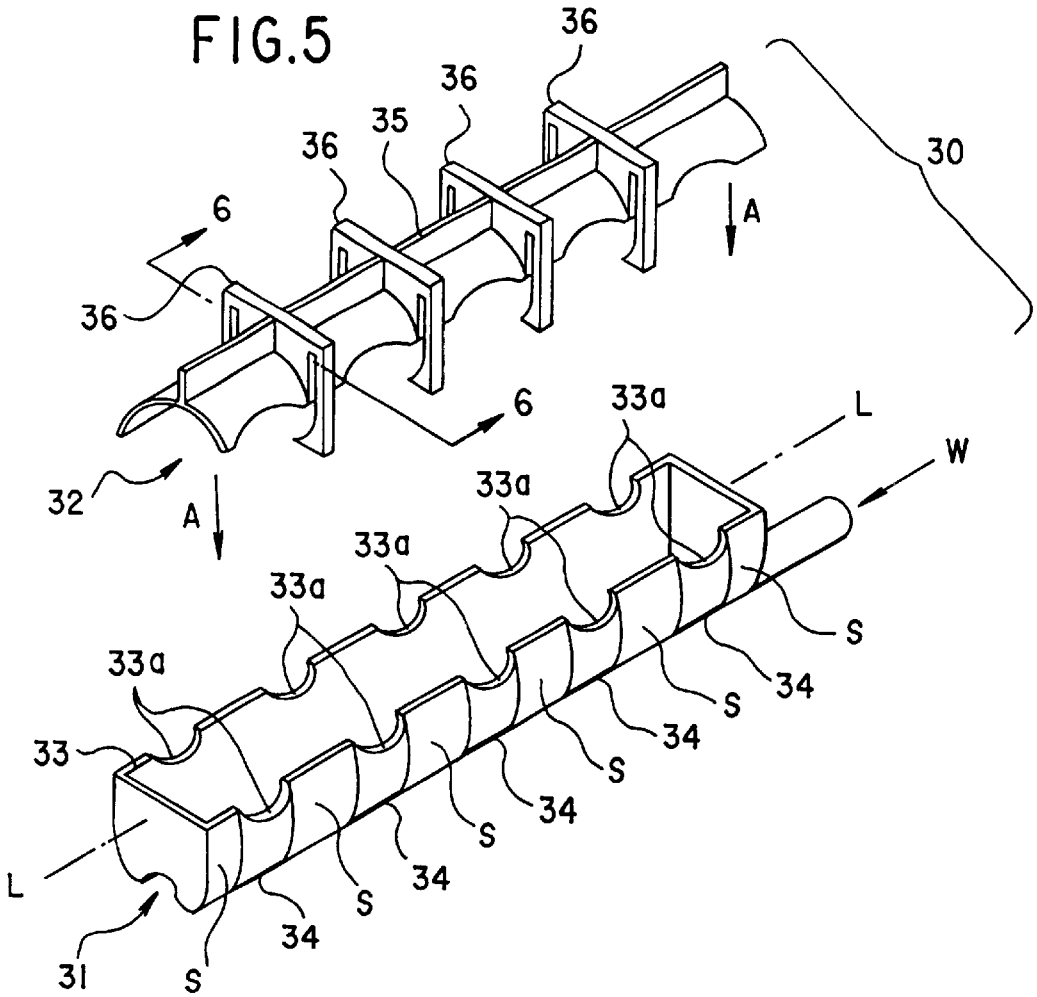
FIG. 5 is an exploded view of the spray tube.

As illustrated in FIG. 5, each spray tube 30 includes an open top channel body 31 having an insert 32 positioned therein. The channel body 31 is substantially cylindrical in shape and has an opening formed therein to receive the insert 32, which has a substantially semi-cylindrical shape. However, it should be noted that the geometric shape of the channel body 31 and insert 32 are not limited to cylindrical and semi-cylindrical, respectfully, but that it is within the scope of this invention to have any suitable geometric shape, i.e., rectangular, triangular, trapezoidal, etc., so long as the body 31 has an open top that can receive a correspondingly shaped insert 32.

A top edge 33 of the channel body 31 is flat and substantially parallel with a longitudinal axis L of the spray tube 30. It should be noted that the outer surface S of a circumference of the channel body 31 is relatively smooth and includes a plurality of grooves 34 formed thereon. The grooves 34 are configured to be depressions in the surface S of the channel body to provide a flow path for the water which will be described in further detail below.

Furthermore, it should be noted that cut out portions 33*a* of the top edge 33 corresponding to the grooves 34 are not parallel to the longitudinal axis L. Rather, the cut out portions 33*a* are closer to the longitudinal axis L of the spray tube 30 than the remaining portion of the top edge 33 in a vertical direction. Thus, water W entering the spray tube 30 will flow over the cut out portions 33*a* and downward along the grooves 34 after reaching a predetermined water level within the channel body 34. The water W flowing over the cut out portions 33*a* and along the grooves 34 is then directed onto the guide plates 21 and 22 positioned below.

Figure 6:
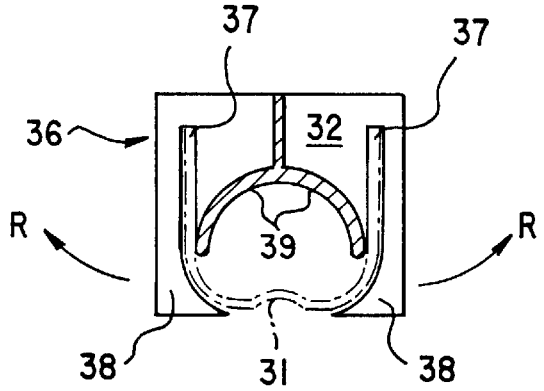
FIG. 6 is a cross-sectional view of the insert placed within the channel body of the spray tube illustrated in FIG. 5.

The insert 32 comprises a longitudinal central rib 35 that extends coaxial to the longitudinal axis L of the channel body 31. A plurality of collars 36 extend from the longitudinal central rib 35 of the insert 32 in a direction transverse to the longitudinal axis L of the channel body 31. The collars 36 are designed to snap fit onto the channel body 31. As shown in FIG. 6, the collars 36 have a slot 37 formed on each side so that the smooth portion S of the channel body 31 can slide therein. Because the water fills to the top of the channel body 31 and then flows down outside of the channel body 31 to the evaporator surface, the water is prevented from traveling up slot 37 and leaking below. Also, slot 37 allows for separation of the individual water streams via insert 32 (collar 36). Each collar 36 also includes a pair of spring arms 38 that clamp onto the smooth surface S of the channel body 31 when the insert is snap fit thereon.

The number of collars 36 is determined by the number of grooves 34 present on the channel body 31. For example only, as illustrated in FIG. 5, the channel body 31 is provided with five grooves 34. Therefore, a collar 36 is positioned between a pair of neighboring grooves 34 such that the insert 32 is provided with four collars 36.

Next, the snap fitting of the insert 32 onto the channel body 31 will be described. The insert 32 is lowered into the open portion of the channel body 31 as indicated by the arrows A. See FIG. 5. As the insert 32 is being lowered, the spring arms 38 of each collar 32 are separated away from the channel body 31 in a radial direction relative to the longitudinal axis L of the channel body 32 as indicated by arrows R in FIG. 6, thereby permitting the smooth portions S of the channel body 31 to slide into the slots 37. When the top edge 33 of the smooth portions S reaches the deepest point of the slots 27, the spring arms 38 are released whereupon they snap fit onto the channel body 32.

Figure 7:
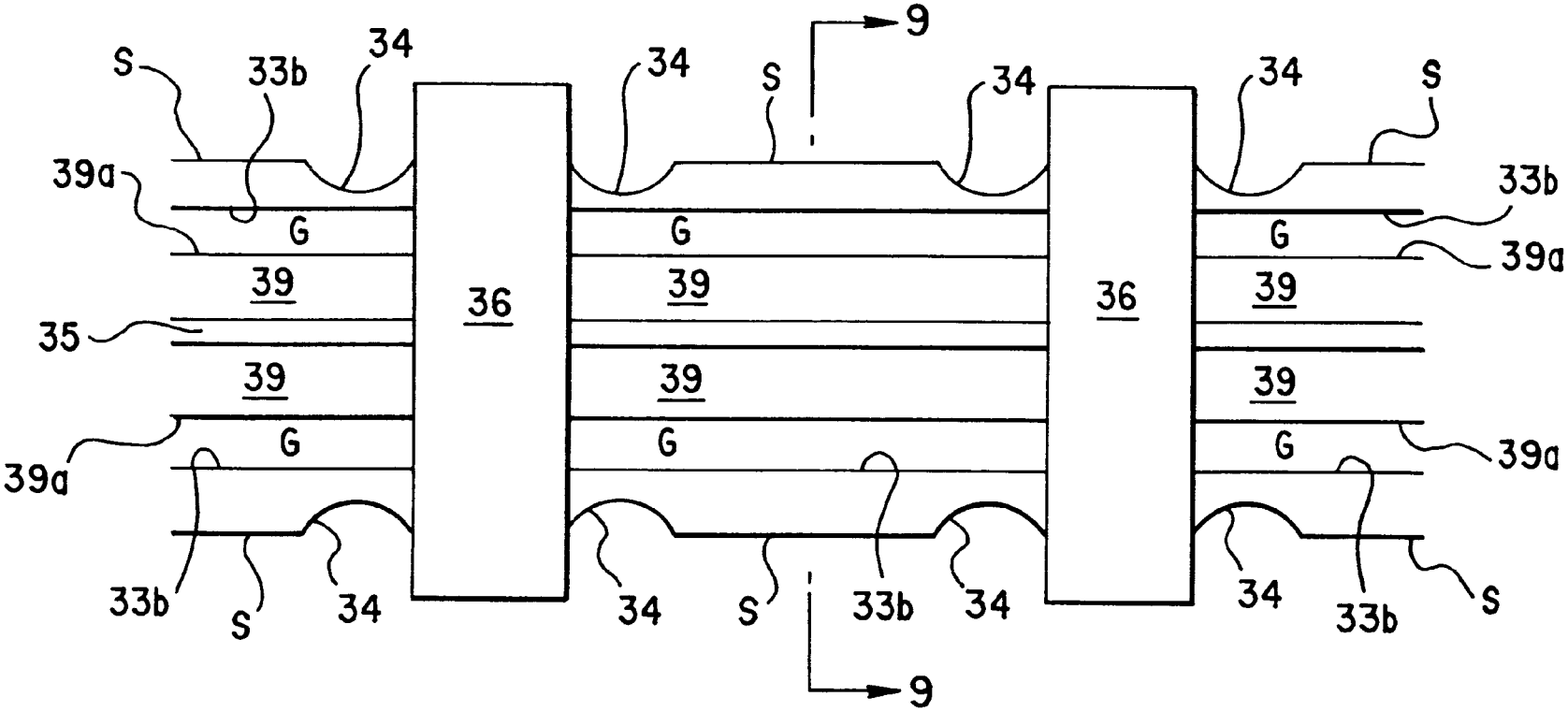
FIG. 7 is a top view of the circled portion of the spray tube illustrated in FIG. 5.

Turning to FIG. 7, which is a top view of the spray tube 30 with the insert 32 snap fit onto the channel body 31, it can be seen that the insert 32 also includes a wing 39 partially spanning the open portion of the channel body 31. The longitudinal central rib 35 and transverse collars 36 are attached to a top surface of the wing 39. The shape of the wing 39 may be any suitable configuration, but the critical feature of the wing 39 is that the wing 39 partially spans the open portion of the channel body 31 such that a gap G results between a distal end 39*a* of the wing 39 and each side face 33*b* of the channel body 31.

Figure 8:
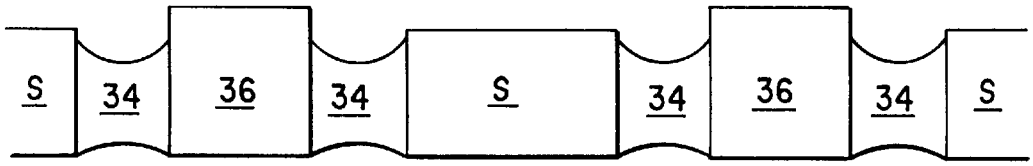
FIG. 8 is a side view of the spray tube of this invention.
Figure 9:
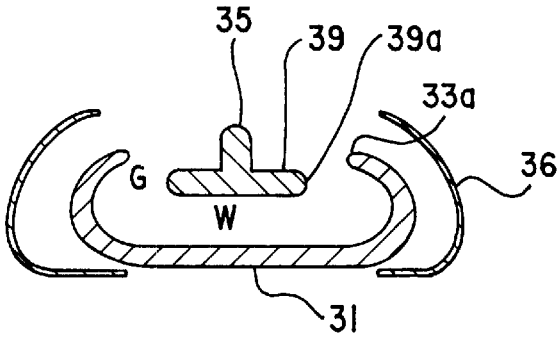
FIG. 9 is a cross-sectional view of the spray tube according to this invention as taken along section line 9—9 of FIG. 7.
Figure 10:
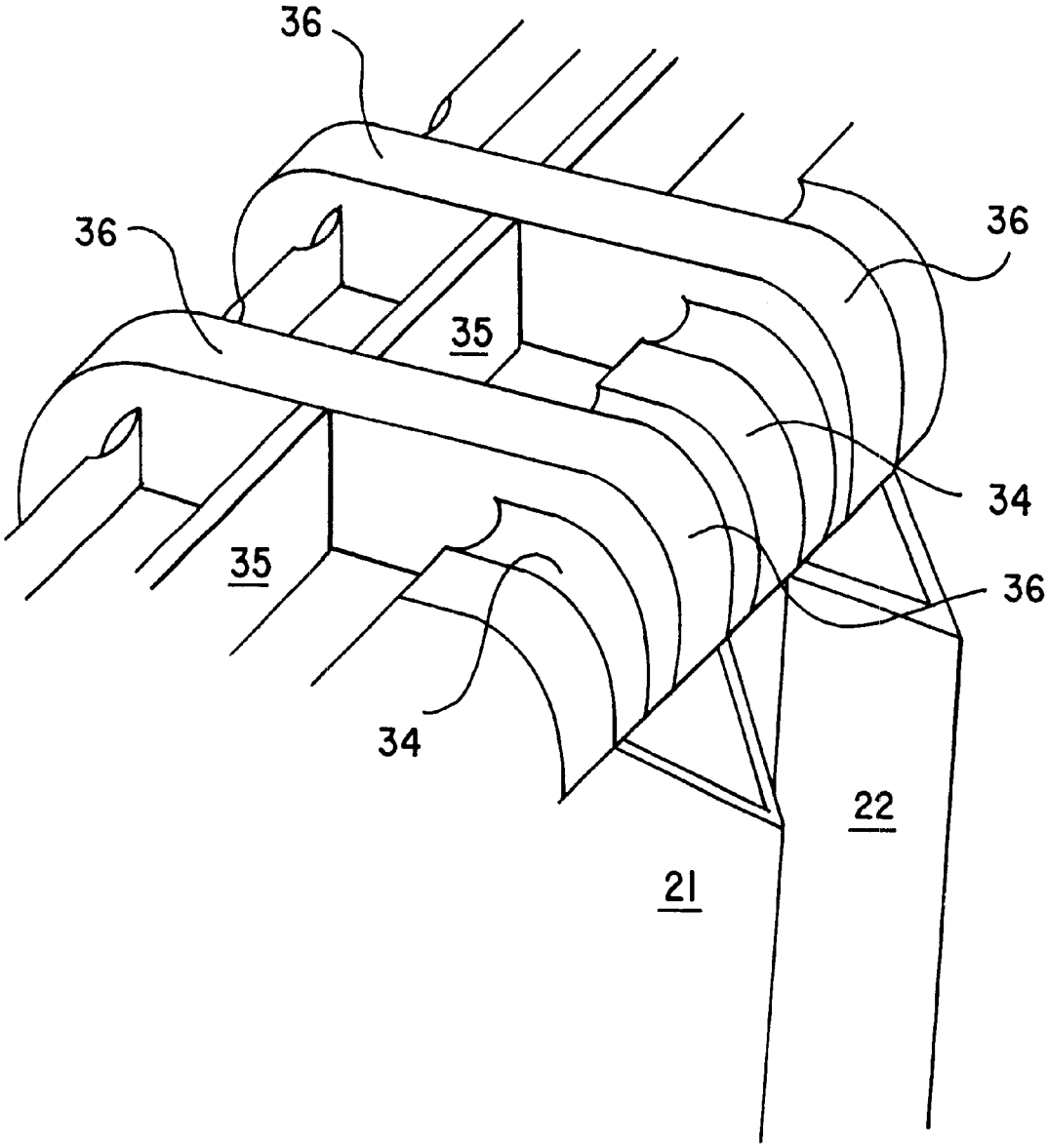
FIG. 10 is a partial fragmented view of the assembled ice water sprinkler positioned on top of the vertically positioned water guide plates of an ice making machine.

Looking at FIG. 9, which is a cross-section of the assembled spray tube 30, it can be understood that as the channel body 31 of the spray tube 30 is filled with water W, the water W rises within the channel body 31. The water W will then flow over the cut out portions 33*a* of the top edge 33 and pass through the gaps G. After passing through the gaps G, the water W overflows the channel body 31 and flows downward along the grooves 34, see FIG. 8, and is then directed to the water guide plates 21 and 22 upon which the collars 36 are situated.

From the above detailed explanation, it is clear that the snap fit relationship of the channel body 31 and insert 32 provides an ice water sprinkler 20 that is easy to form, clean and maintain. Furthermore, as the resulting ice water sprinkler 20 contains no apertures that can get clogged, but rather uses the gaps G between the channel body 31 and insert 32 to direct the water W onto the water guide plates 21 and 22, the possibility of there being any down time of the ice manufacturing machine due to clogging is very unlikely. Also, the amount of time needed to manufacture the spray tubes 30 is substantially decreased as the step of verification of the holes being formed properly in the tube is eliminated due to the inventive structure of the resulting spray tubes.

While the invention has been described in conjunction with a specific embodiment thereof, it is evident that many alternatives, modifications and variations may be apparent to those skilled in the art. Accordingly, the specific embodiment of the invention as set forth herein is intended to be illustrative, not limiting. Various changes may be made without departing from the spirit and scope of the invention as set forth in the following claims.

What is claimed is:

1. An ice water sprinkler of a water sprinkling apparatus, the ice water sprinkler being connectable to a water supply joint by a coupling portion and having at least two spray tubes, each spray tube comprising:

an open top channel body having a flat top edge substantially parallel with a longitudinal axis of said channel body, said top edge including a plurality of cut out portions positioned closer to said longitudinal axis than said top edge in a vertical direction; and an insert attached to said channel body, wherein at least two gaps are defined between said channel body and said insert such that water flowing into said spray tube is discharged through said gaps and over said cut out portions.

2. The spray tube according to claim 1, wherein said channel body further comprises a smooth outer surface and a plurality of grooves formed thereon, said grooves being transverse relative to said longitudinal axis.

3. The spray tube according to claim 2, wherein each of said grooves is aligned with a corresponding cut out portion, thereby defining a flow path for the water discharged through said gaps.

4. The spray tube according to claim 1, wherein said insert comprises:

a longitudinal central rib extending coaxial to said longitudinal axis of said channel body; and a plurality of collars extending from said central rib in a direction transverse to said longitudinal axis of said channel body.

5. The spray tube according to claim 4, wherein each of said collars includes a slot on each side of said central rib, each slot configured to receive said channel body and defining a spring arm biasable such that said insert can be snap fit onto said channel body.

6. The spray tube according to claim 5, wherein a number of grooves exceeds a number of collars by one, such that each pair of neighboring grooves is separated by a corresponding collar.

7. The spray tube according to claim 4, further comprising a wing whereon said central rib and said collars of said insert are attached, said wing partially spanning an open portion of said channel body such that said gaps are formed between distal ends of said wing and each side face of said channel body.

8. The spray tube according to claim 7, wherein each of said collars includes a slot on each side of said central rib, each slot configured to receive said channel body and defining a spring arm biasable such that said insert can be snap fit onto said channel body.

9. The spray tube according to claim 8, wherein a number of grooves exceeds a number of collars by one, such that each pair of neighboring grooves is separated by a corresponding collar.

10. An ice water sprinkler of a water sprinkling apparatus, the ice water sprinkler comprising:

a water supply joint that supplies water;

coupling portion connected to said water supply portion;

at least two spray tubes, each spray tube connected to said coupling portion and comprising:

an open top channel body having a flat top edge substantially parallel with a longitudinal axis of said channel body, said top edge including a plurality of cut out portions positioned closer to said longitudinal axis than said top edge in a vertical direction; and an insert attached to said channel body, wherein at least two gaps are defined between said channel body and said insert such that water flowing into said spray tube is discharged through said gaps and over said cut out portions.

11. The ice water sprinkler according to claim 10, wherein said channel body further comprises a smooth outer surface and a plurality of grooves formed thereon, said grooves being transverse relative to said longitudinal axis.

12. The ice water sprinkler according to claim 11, wherein each of said grooves is aligned with a corresponding cut out portion, thereby defining a flow path for the water discharged through said gaps.

13. The ice water sprinkler according to claim 10, wherein said insert comprises:

a longitudinal central rib extending coaxial to said longitudinal axis of said channel body; and a plurality of collars extending from said central rib in a direction transverse to said longitudinal axis of said channel body.

14. The ice water sprinkler according to claim 13, wherein each of said collars includes a slot on each side of said central rib, each slot configured to receive said channel body and defining a spring arm biasable such that said insert can be snap fit onto said channel body.

15. The ice water sprinkler according to claim 14, wherein a number of grooves exceeds a number of collars by one, such that each pair of neighboring grooves is separated by a corresponding collar.

16. The ice water sprinkler according to claim 13, further comprising a wing whereon said central rib and said collars of said insert are attached, said wing partially spanning an open portion of said channel body such that said gaps are formed between distal ends of said wing and each side face of said channel body.

17. The ice water sprinkler according to claim 16, wherein each of said collars includes a slot on each side of said central rib, each slot configured to receive said channel body and defining a spring arm biasable such that said insert can be snap fit onto said channel body.

18. The spray tube according to claim 17, wherein a number of grooves exceeds a number of collars by one, such that each pair of neighboring grooves is separated by a corresponding collar.

* * * * *